US006540103B2

(12) United States Patent
Silvers

(10) Patent No.: US 6,540,103 B2
(45) Date of Patent: Apr. 1, 2003

(54) DIAPER DISPENSING AND DISPOSAL APPARATUS

(76) Inventor: Brian Silvers, 1760 Fox Field Dr., Belvidere, IL (US) 61008

( * ) Notice: Subject to any disclaimer, the term of this patent is extended or adjusted under 35 U.S.C. 154(b) by 0 days.

(21) Appl. No.: 09/898,695

(22) Filed: Jul. 3, 2001

(65) Prior Publication Data

US 2003/0006244 A1 Jan. 9, 2003

(51) Int. Cl.[7] ..... A47F 1/00
(52) U.S. Cl. ..... 221/96; 221/102
(58) Field of Search ..... 221/96, 97, 102, 221/33, 45, 241; 312/42, 71, 50, 212; 206/37, 561, 581

(56) References Cited

U.S. PATENT DOCUMENTS

| | | | | |
|---|---|---|---|---|
| 3,747,802 A | * | 7/1973 | Uroshevich | 206/494 |
| D285,906 S | | 9/1986 | Tyler | D9/425 |
| 4,685,559 A | | 8/1987 | Titus | 206/38 |
| 4,706,845 A | * | 11/1987 | Schnurer et al. | 221/102 |
| D310,748 S | | 9/1990 | Embree et al. | D34/40 |
| 4,961,522 A | | 10/1990 | Weber | 224/151 |
| D314,279 S | | 2/1991 | Hotchkiss | D3/30.1 |
| 5,036,997 A | | 8/1991 | May et al. | 220/335 |
| 5,117,979 A | | 6/1992 | Brightbill | 206/372 |
| D329,135 S | | 9/1992 | Embree | D3/30.1 |
| D330,161 S | | 10/1992 | Schuh | D9/423 |
| 5,433,373 A | | 7/1995 | Zoeller | 229/117.26 |
| 5,443,161 A | | 8/1995 | Jonese | 206/581 |
| D367,172 S | | 2/1996 | Brightbill et al. | D3/310 |
| D367,609 S | | 3/1996 | Frank et al. | D9/425 |
| D371,030 S | | 6/1996 | Hall | D6/515 |
| 5,624,095 A | | 4/1997 | Zissu | 248/231.81 |
| 5,638,957 A | | 6/1997 | Brasier | 206/581 |
| 5,655,680 A | | 8/1997 | Asbach et al. | 220/404 |
| 5,678,727 A | | 10/1997 | Rice | 221/98 |
| 5,706,950 A | | 1/1998 | Houghton et al. | 206/581 |
| D412,439 S | | 8/1999 | Cormack | D9/425 |
| 6,182,022 B1 | | 1/2001 | Mayle et al. | 702/182 |

* cited by examiner

*Primary Examiner*—Kenneth W. Noland
(74) *Attorney, Agent, or Firm*—Leydig, Voit & Mayer, Ltd.

(57) ABSTRACT

An apparatus for dispensing new diapers and disposing of used diapers. The apparatus comprises a container having a base, a plurality of outer walls, an enclosed area, and a partition wall. The partition wall divides container into a diaper compartment for storing new diapers, and a waste compartment for storing used diapers. One of the outer walls includes a slot extending to the diaper compartment. The slot is for dispensing of individual diapers. An outer lid can be positioned over the container to enclose both of the diaper compartment and the waste compartment. An inner lid is provided inside the container covering the diaper compartment to prevent odor from permeating diapers in the diaper compartment. A wipe receptacle is mounted to the container adjacent the diaper slot. The wipe receptacle is adapted to contain wet baby wipes in a convenient location for use during diaper changes.

23 Claims, 9 Drawing Sheets

DIAPER DISPENSING AND DISPOSAL APPARATUS

FIELD OF THE INVENTION

The present invention relates generally to containers, and more specifically to containers for dispensing and disposing of diapers.

BACKGROUND OF THE INVENTION

Parents change the diapers of babies frequently and often several times per day. In will readily be appreciated by parents everywhere that changing the diapers of babies is a difficult task. Many parents have been frustrated by the absence of any good products on the market for assisting parents in the diaper changing task in a convenient manner.

BRIEF SUMMARY OF THE INVENTION

The present invention is directed toward an apparatus for dispensing new diapers and disposing of used diapers. The apparatus comprises a container having a base, outer walls extending from the base to provide an enclosed area, and a partition wall. The partition wall divides the enclosed area into a diaper compartment for storing new diapers, and a waste compartment for storing used diapers. One of the outer walls includes a diaper dispensing slot extending to the diaper compartment. The slot is dimensioned closely to one of the new diapers such that new diapers are retained in the diaper compartment and such that new diapers may be removed through the slot. An outer lid can be positioned over the container to enclose both of the diaper compartment and the waste compartment. Preferably, an inner lid is provided inside the container covering the diaper compartment or the waste compartment to prevent odor from permeating diapers in the diaper compartment. A wipe receptacle may be mounted to the container adjacent the diaper slot. The wipe receptacle is adapted to contain wet baby wipes in a convenient location for use during diaper changes.

Other objectives and advantages of the invention will become more apparent from the following detailed description when taken in conjunction with the accompanying drawings.

BRIEF DESCRIPTION OF THE DRAWINGS

The accompanying drawings incorporated in and forming a part of the specification illustrate several aspects of the present invention, and together with the description serve to explain the principles of the invention. In the drawings.

While the invention will be described in connection with certain preferred embodiments, there is no intent to limit it to those embodiments. On the contrary, the intent is to cover all alternatives, modifications and equivalents as included within the spirit and scope of the invention as defined by the appended claims.

DETAILED DESCRIPTION OF THE INVENTION

Figure 1:
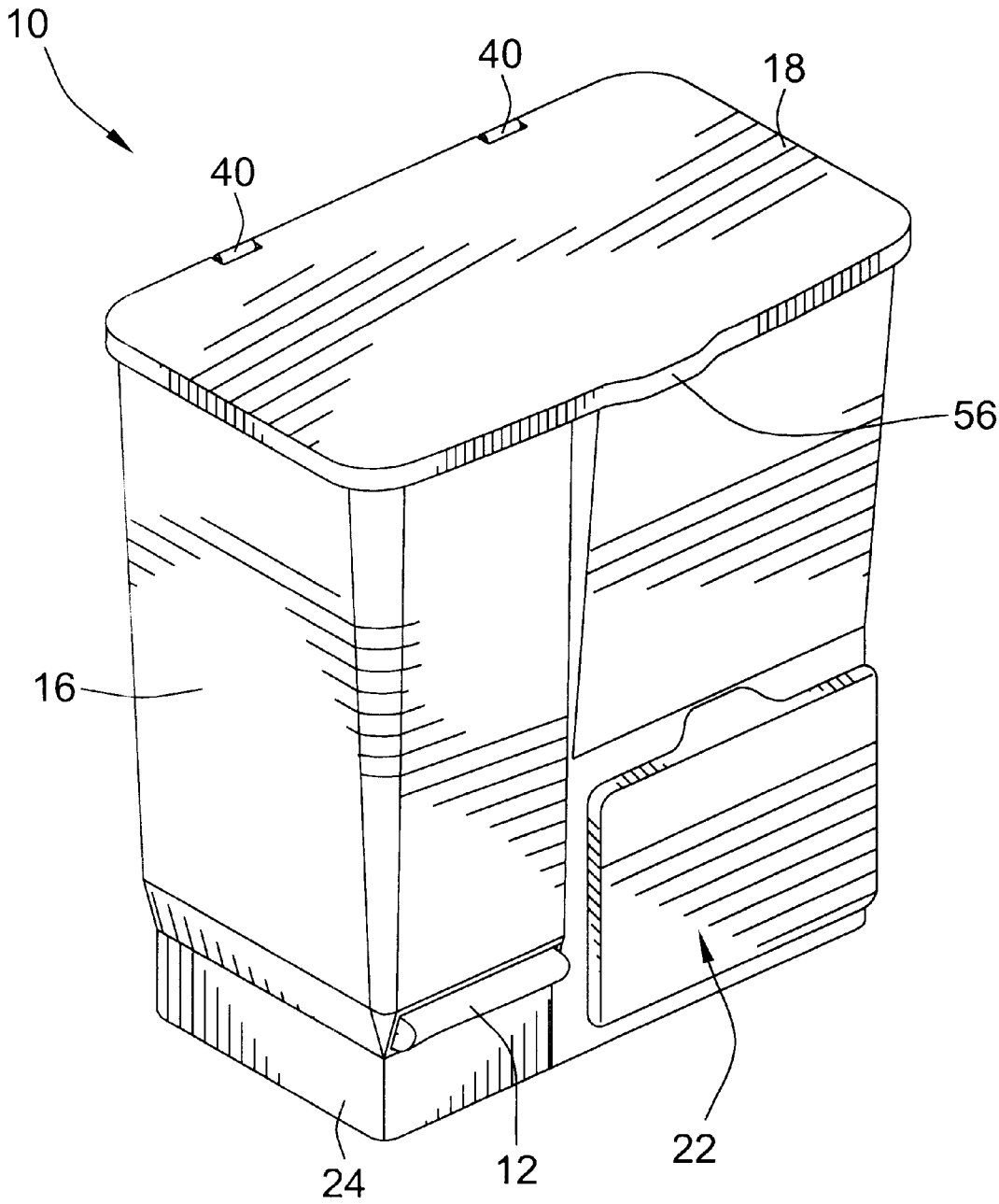
FIG. 1 is an isometric view of an apparatus for dispensing and disposing of diapers with all of the lids closed according to a preferred embodiment of the present invention.
Figure 6:
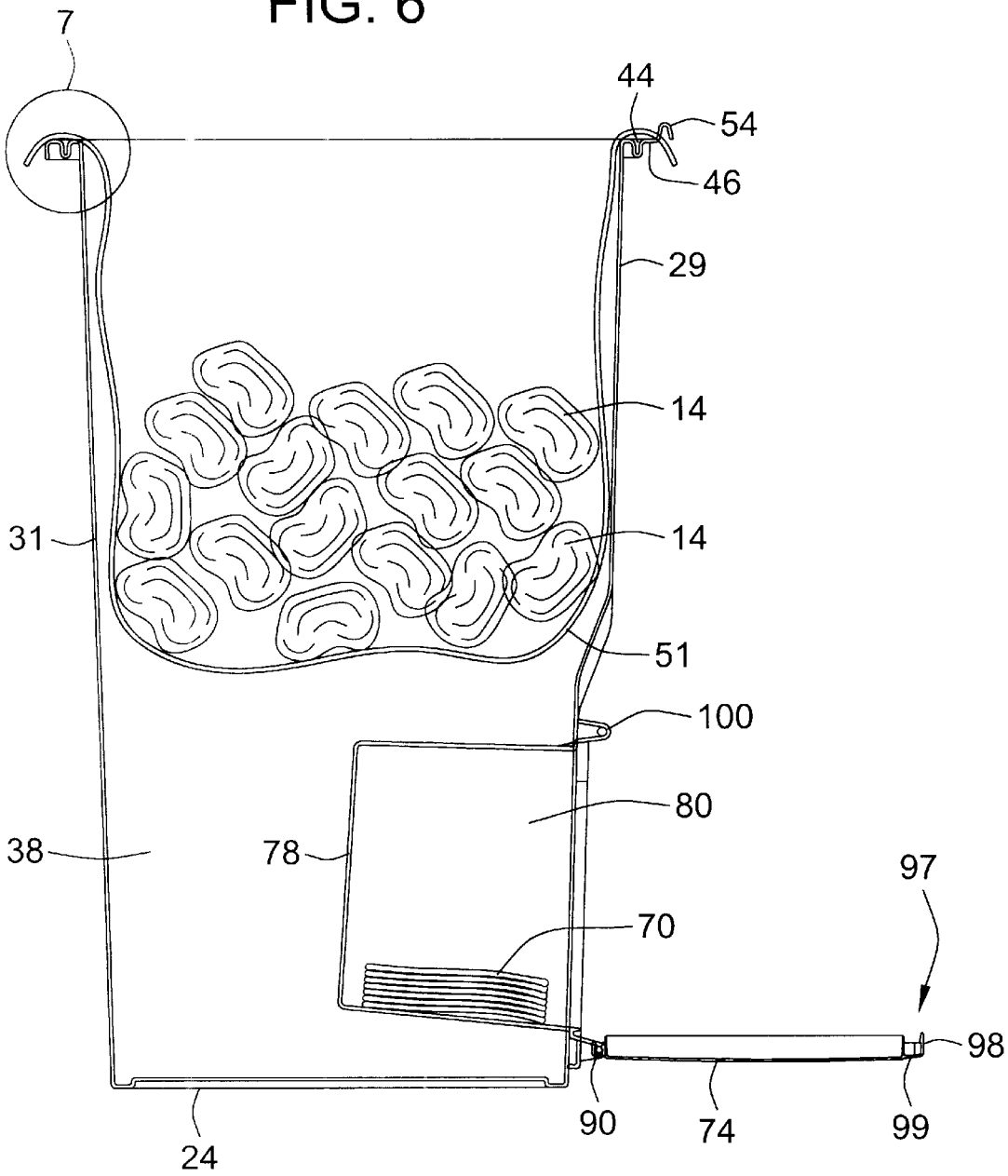
FIG. 6 is a cross section of FIG. 3 taken about line 6—6 further with a trash bag inserted into the waste compartment containing used diapers and other waste, and with the wipe receptacle being mounted to the container.

For purpose of illustration, a preferred embodiment of the present invention has been illustrated as an apparatus 10 for dispensing of new diapers 12 and disposing of used diapers 14 (See FIG. 6) as shown in FIG. 1. In a preferred embodiment the apparatus comprises a container 16, an outer lid 18, an inner lid 20, and a wipe container 22, as collectively illustrated in FIGS. 1 and 2 and as individually illustrated in the remaining Figures. The container 16, the outer lid, 18, the inner lid 20 and the wipe receptacle 22 are all made from resilient plastic material.

Referring to FIG. 2 and FIGS. 3–7, the container 16 includes a base 24 at its bottom end for resting upon a floor surface or other surface. An outer wall 26 extends vertically upward from the base 24 and surrounds an enclosed area 28. In the preferred embodiment, the outer wall 26 is comprised of two pairs of generally parallel sides 29–32 (the pairs being perpendicular with one another) forming a generally rectangular container 16 but other shapes may be used including oval or circular. The container 16 also includes an integral internal partition wall 34 extending vertically upward from the base 24 and between a pair of opposing sides 29, 31. The partition wall 34 divides the enclosed area 28 into a diaper compartment 36 and a waste compartment 38. The waste compartment 38 may hold a trash bag 51 (See FIG. 6) and is provided to store used diapers 14. The diaper compartment 36 stores a vertical stack of new diapers 12. The diaper compartment 36 has a horizontal width that closely corresponds to the horizontal width of a diaper 12 for retention of new diapers to maintain the new diapers 12 in a vertical stack. The diaper compartment 36 also has a horizontal depth that also closely corresponds to the horizontal depth of a diaper 12 for similar reasons. The horizontal depth may be adjustable by an insertable and removable partition wall (not shown) that fits into one or more sets of longitudinal grooves 39, thereby allowing the diaper compartment to be smaller or larger depending upon the size of the diaper or age of the baby.

Figure 4:
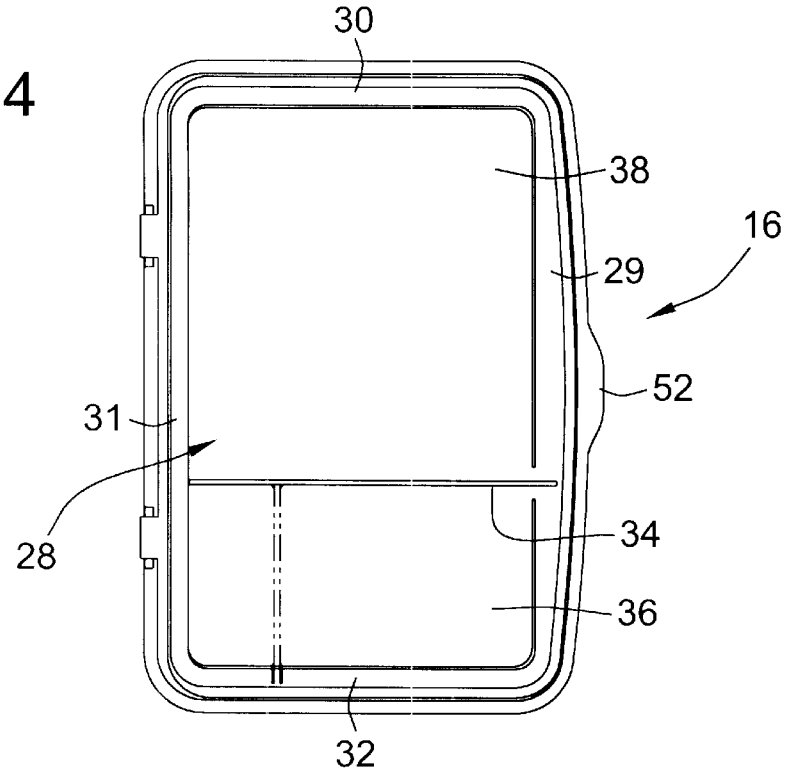
FIG. 4 is a top view of the unassembled container illustrated in FIG. 3.
Figure 7:
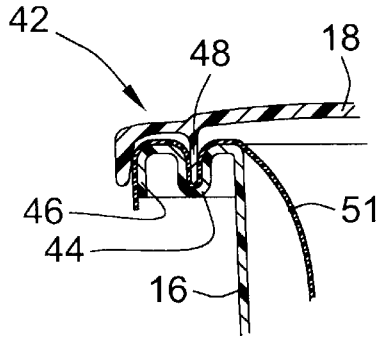
FIG. 7 is an enlarged section view of the interface between the container as illustrated in FIG. 6 and the outer container lid as illustrated in FIGS. 13 and 14, with a trash bag therebetween.

The outer lid 18 is best illustrated in FIGS. 2, 7, 13 and 14. The outer lid 18 may be pivotably mounted to the container 16 by hinges 40 along one of the container sides 31. The outer lid 18 is normally horizontal in a closed position covering the entirely enclosed area 28 of the container 16. As shown in FIG. 7, a seal 42 is preferably provided between the outer lid 18 and the outer wall 26 of the container 16 to prevent odor from used diapers 14 contained in the waste compartment 38 from escaping to the surrounding room. The seal 42 is illustrated as a tongue and groove type, comprising a groove 44 formed vertically into an outward projecting lip 46 along the top end of the outer wall 26 and a tongue 48 projecting vertically downward from the outer lid 18 and into the groove 44 forming a seal via an interference fit. As shown in FIG. 4, the groove extends along only three sides 29, 30, 32. Along the side 31 where the hinges 40 are provided, clearance for pivoting movement is desired. As such, the seal 14 is maintained through horizontal interference between the tongue 48 and only one of the groove walls 50 that continues along this side 31. When in use, a trash bag 51 is typically placed into the waste compartment 38. The top edge of the trash bag 51 may be wrapped around the outer lip 46 of the container 16 with the lining near the top edge pressed into the groove 44 as the outer lid 18 is closed, or may also otherwise be latched to supporting structures (not shown) inside the container 16 for retention.

A snap connection 52 between the outer lid 18 and the container 16 along the front side 29 may also be provided to keep a vertical downward biasing force on the outer lid 18 to better ensure proper vertical engagement between the lid and container for the seal 42. The snap connection 52 includes a snapping structure 54 extending from a lift tab 56 on the lid 18 and a corresponding snapping structure 58 projecting from the front side 29 of the container 16. The snapping structures 54, 58 snap vertically past one another as the lid is closed to provide a downward biasing force on the lid. The snapping structures 54, 58 are unsnapped by manually lifting the lift tab 56.

Figure 2:
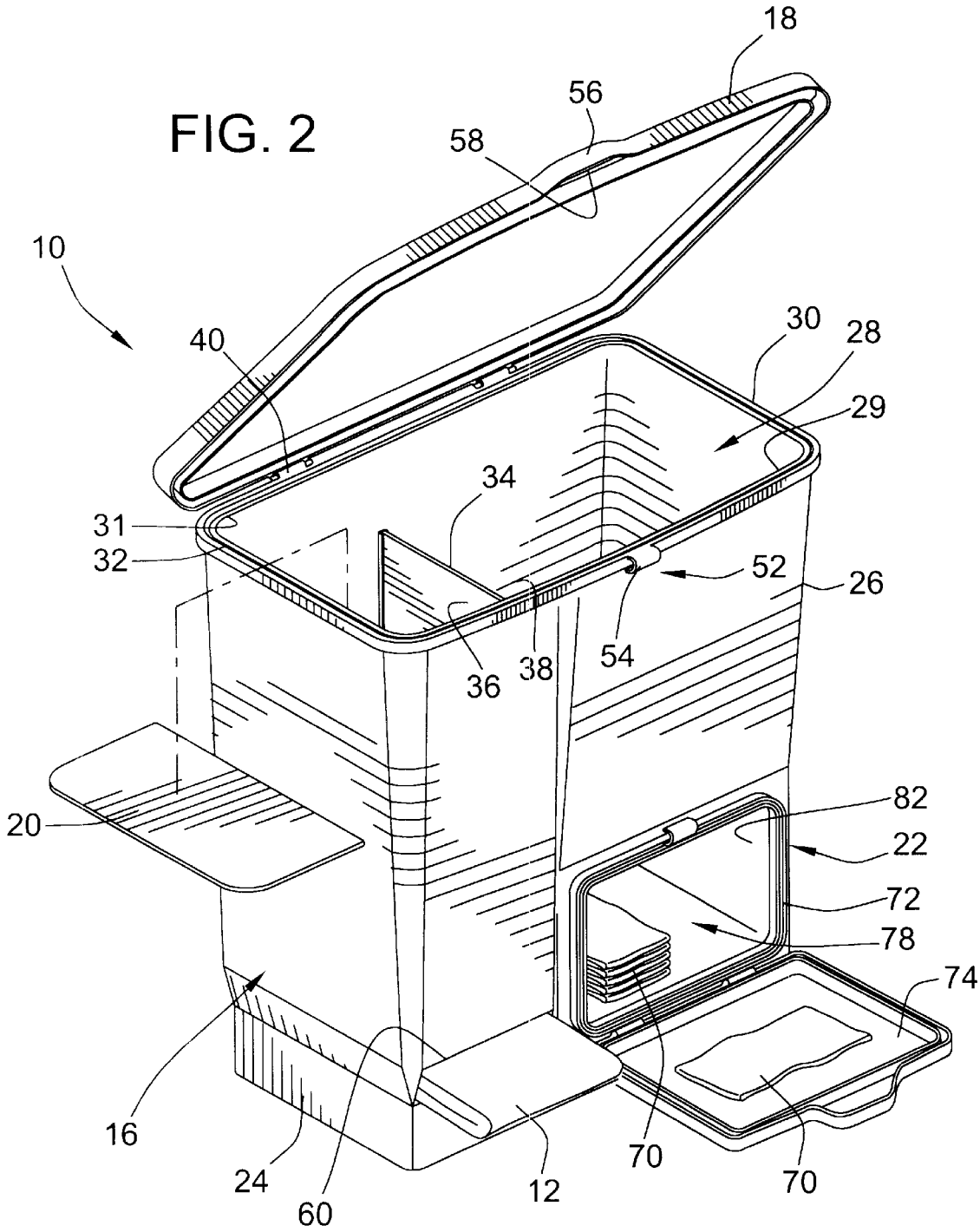
FIG. 2 is an exploded isometric view of the apparatus illustrated in FIG. 1 with all of the lids open.
Figure 3:
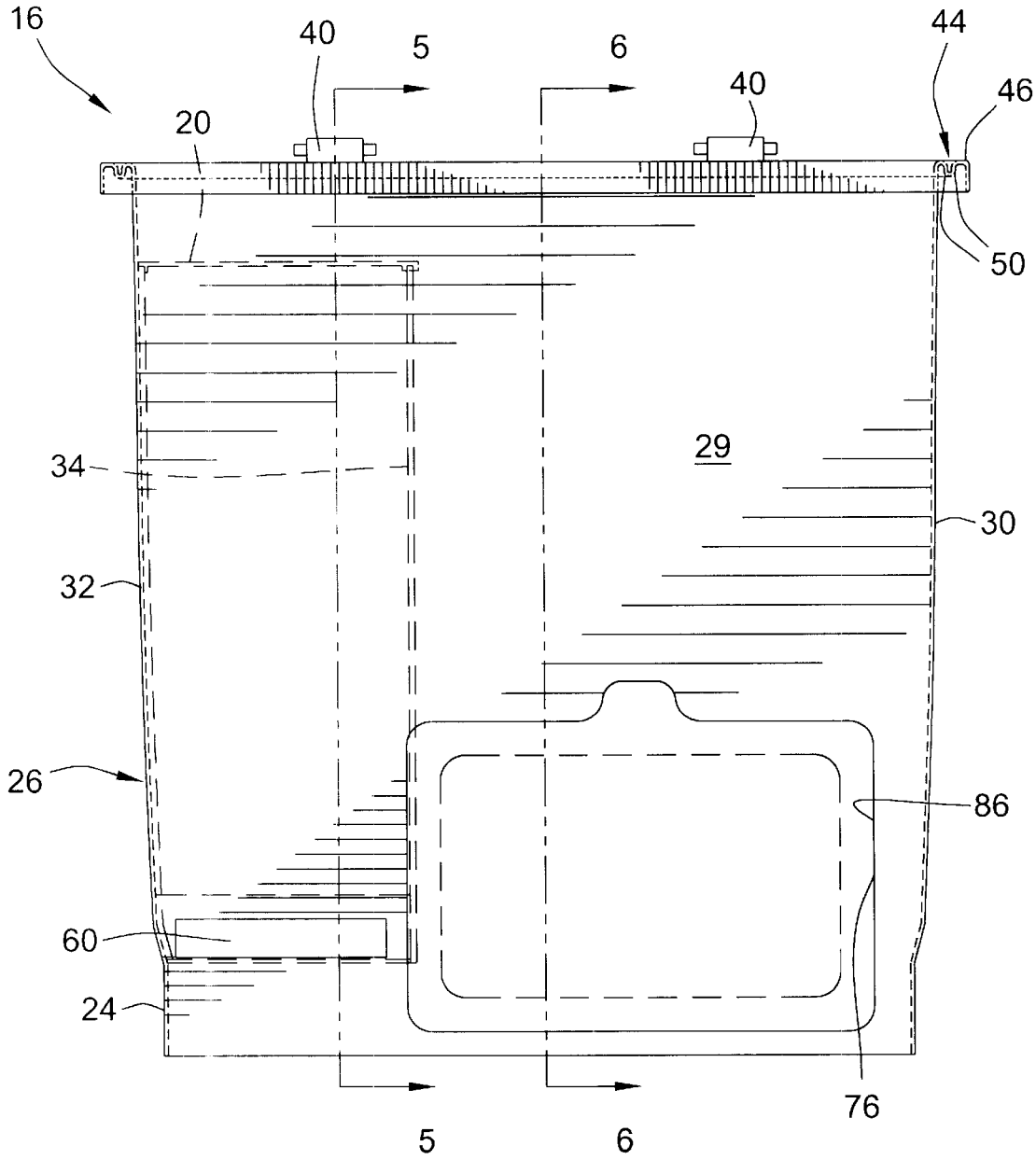
FIG. 3 is a front view of the unassembled container of the apparatus illustrated in FIGS. 1 and 2.
Figure 5:
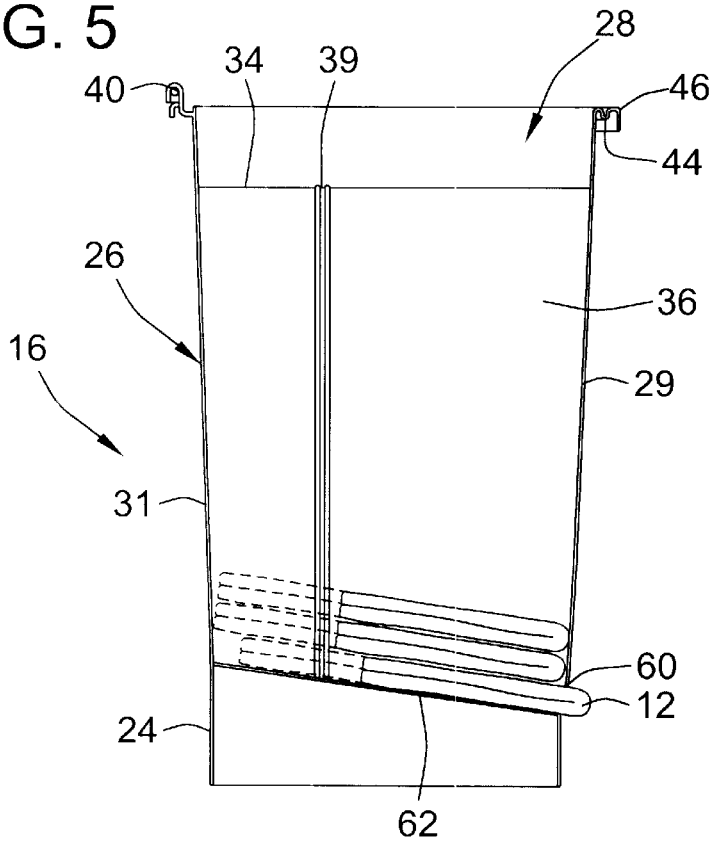
FIG. 5 is a cross section of FIG. 3 taken about line 5—5 further with a vertical stack of diapers being illustrated inside the diaper compartment of the unassembled container.

Referring to FIGS. 2, 3, and 5, a rectangular slot 60 extends through the container 16 into the diaper compartment 36 through the front side 29. The slot 60 is dimensioned closely to one of the new diapers 12. Specifically, the slot 60 is small enough such that new diapers 12 are retained in the diaper compartment 36, but also large enough that new diapers 12 may be easily pulled through the slot 60 for available use. The slot 60 is positioned at the bottom of the diaper compartment 36 such that the bottom diaper of the stack of new diapers 12 is removed each time. The bottom surface 62 of the diaper compartment 36 is sloped or angled downward toward the slot 60 such that diapers are naturally inclined to slide toward the slot for readily available removal.

Figure 11:
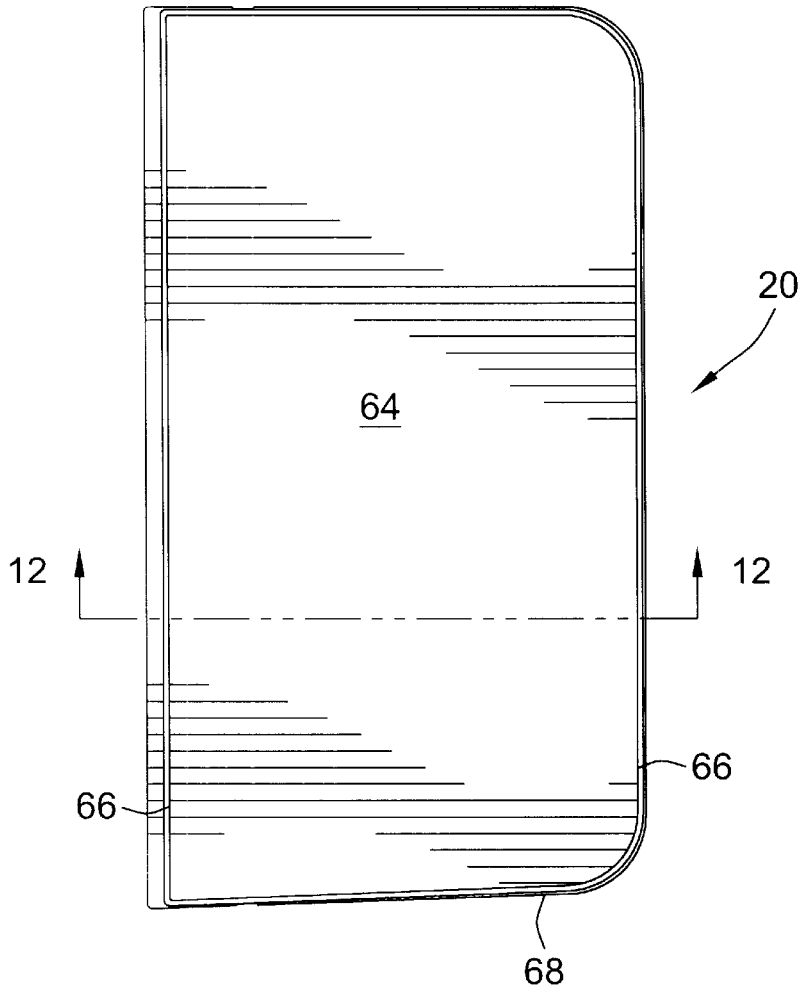
FIG. 11 is a bottom view of the inner lid of the apparatus illustrated in FIG. 2 used to cover the diaper compartment of the container.
Figure 12:
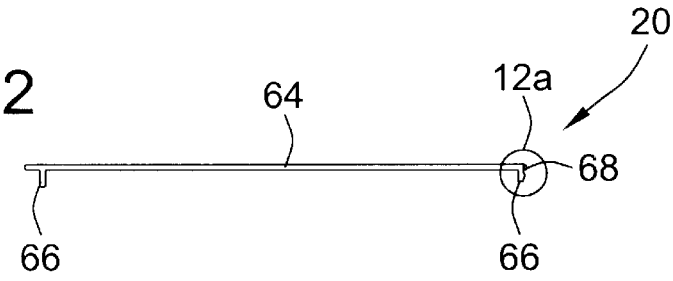
FIG. 12 is a cross section of FIG. 11.
Figure 12A:
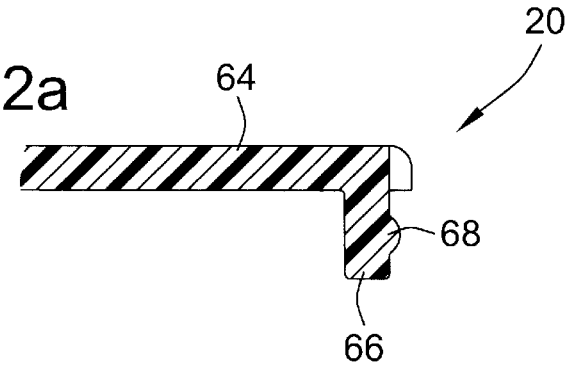
FIG. 12*a* is an enlarged view of a portion of FIG. 12 taken about detail 12*a*.
Figure 13:
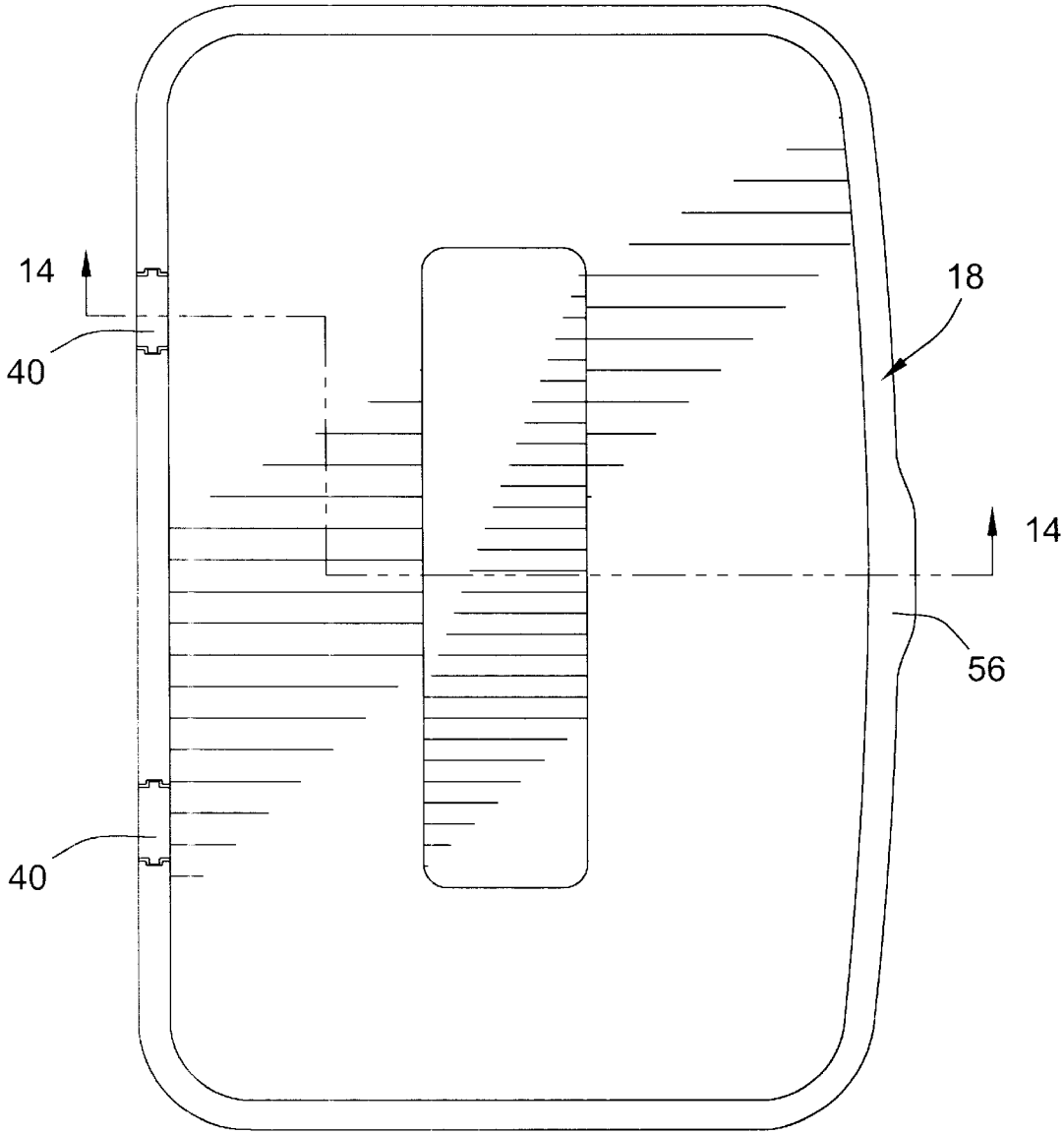
FIG. 13 is a top view of the outer lid for the container of the apparatus illustrated in FIG. 2.
Figure 14:
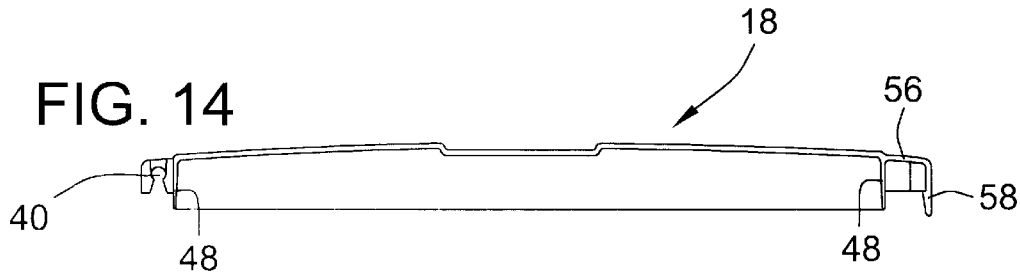
FIG. 14 is a cross section of FIG. 13.

To prevent odor from the waste compartment 38 from permeating new diapers 12 stored in the diaper compartment 36, the preferred embodiment also employs an inner lid 20 as shown in FIGS. 2, 11, and 12. The inner lid 20 is contained within the container 16 inside the outer lid 18 for separating the diaper and waste compartments 36, 38. In the disclosed embodiment, inner lid 20 covers the diaper compartment 36. The inner lid 20 rests on the partition wall 34 and is wedged against a container side 32. The partition wall 34 vertically extends only partially the vertical height of the container 16 to prevent interference between the inner and outer lids 16, 18. The inner lid 20 includes a horizontal plate portion 64 and vertical flange portion 66 integrally connected to the plate portion 64. The plate portion 64 extending horizontally over the top of the diaper compartment 36 and includes an outer edge that rests on a top surface of the partition wall 34. The flange portion 66 depends vertically downward from the plate portion 64 and engages the partition wall 34 and outer wall 26 within the diaper compartment 36. A seal is provided between the inner lid 20 and the diaper compartment 36 to prevent odor from entering the diaper compartment. In the preferred embodiment, the seal is a rib 68 projecting horizontally from the flange portion 66 in engagement with the partition wall 34 and the outer wall 26.

Referring to FIGS. 2, 6 and 8–10, it is an aspect of the present invention that the apparatus 10 includes a wipe container 22 for holding wet baby wipes 70. The wipe container 22 includes a wipe receptacle 72 and a receptacle lid 74. The wipe receptacle 72 is mounted to the diaper container 16 proximate the diaper slot 60 towards the bottom end of the container 16 such that the baby wipes 70 are within close reach of new diapers 12. As shown in FIG. 1, the wipe receptacle 76 may extend at a perpendicular orientation relative to the larger diaper container 16. The wipe receptacle 72 includes a closed end 78, an open end 80 and a rectangular sidewall 82 extending horizontally between closed and open ends 78, 80.

In the disclosed embodiment the wipe receptacle 72 is snapped into a rectangular opening 76 through the front side 29 such that the but end of the wipe receptacle 72 is positioned in the waste compartment 38. Preferably, the wipe receptacle 72 is snapped into the rectangular opening 76 in a substantially non-removable manner such that the wipe receptacle 72 does not come unsnapped when opening and closing the lids or during normal use and transportation of the apparatus 10 (e.g. requiring a prying force for removal). To facilitate mounting, the outer sidewall 82 has a slight draft which contracts toward the closed end 78. Proximate the open end 80, a rectangular groove structure 84 is provided that receives the wall edge 86 that surrounds the rectangular opening 76. The groove structure 84 extends around at least three sides of the sidewall 82. To facilitate sliding of the wall edge 86 into the groove structure 84 during initial assembly, the leading groove wall includes a cam surface 88 for deflecting the wall edge 86 outwardly. Once the wall edge 86 clears the cam surface 88, the wall edge 86 releases and snaps into the groove structure 84 and is trapped. The hard perpendicular edges of the groove structure 84 prevent removal of the wipe receptacle 72.

The receptacle lid 74 is pivotally connected to the wipe receptacle 72 via a hinge 90 for selectively opening and closing the open end 80 of the wipe receptacle 72. Preferably, the lid 74 opens by pivoting down to a horizontal position (e.g. the hinge is a 90° hinge disposed along the bottom edge of the wipe receptacle 72), thereby providing a table like surface that can be used for temporarily resting a wipe or new diaper. A seal 92 is arranged between the lid 74 and wipe receptacle 72 for preventing liquid from evaporating out of the wet baby wipes 70 when the wipe container is closed.

Figure 8:
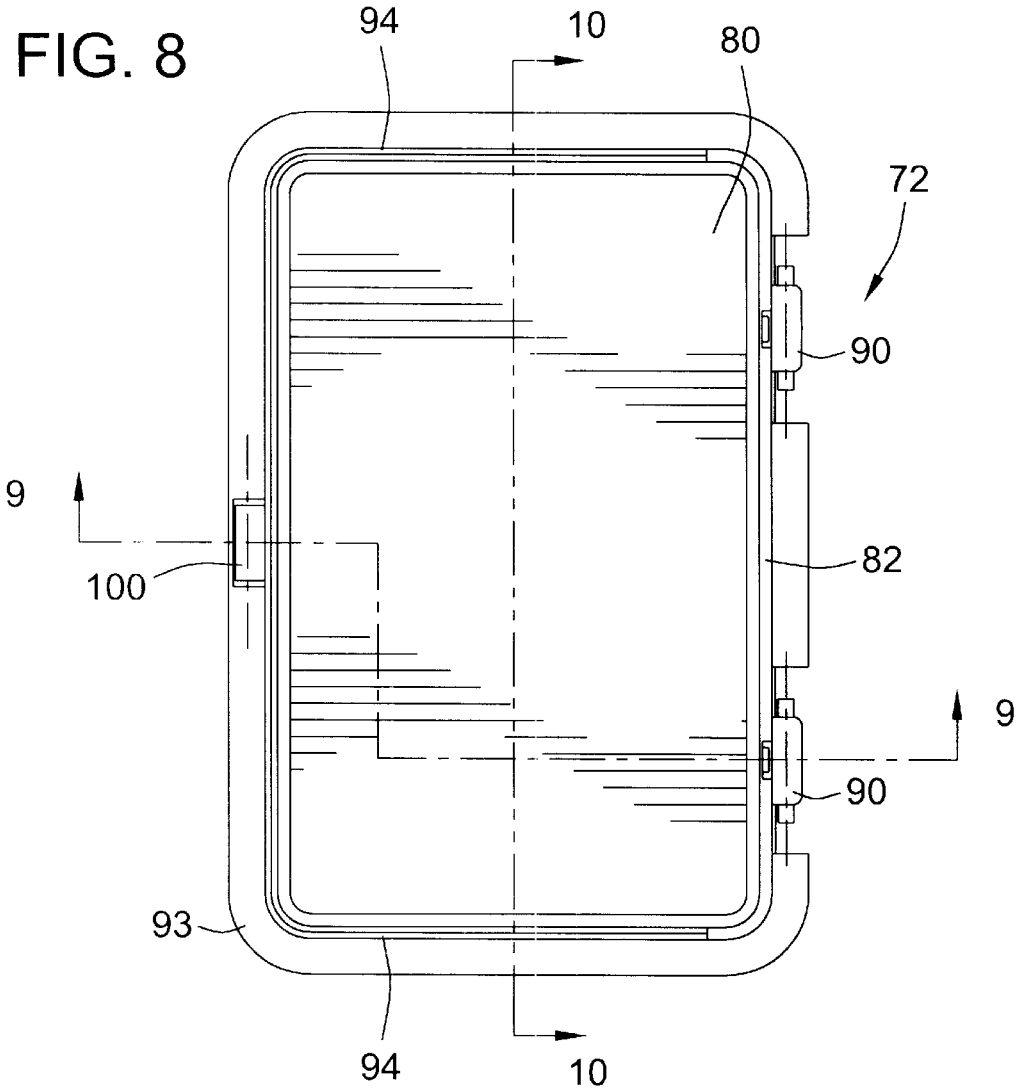
FIG. 8 is a front view of the unassembled wipe receptacle for the apparatus of FIG. 1.
Figure 9:
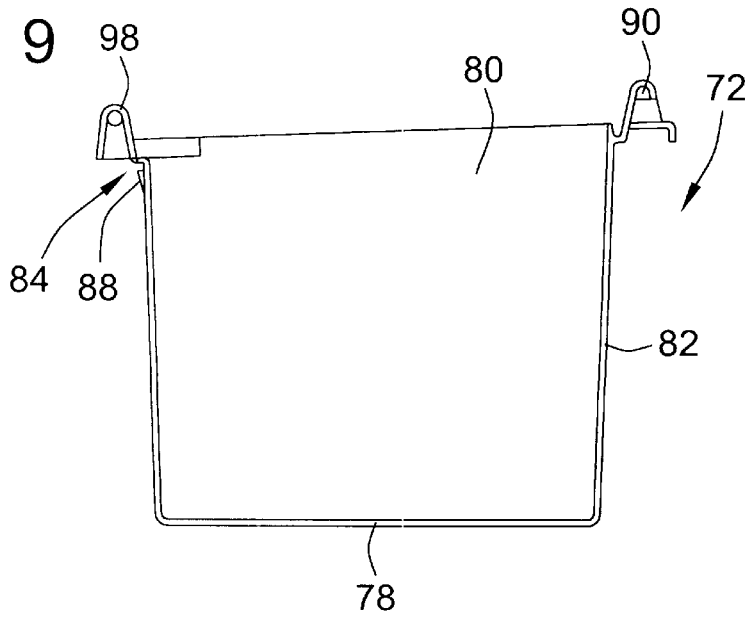
FIG. 9 is a cross section FIG. 8 taken about line 9—9.
Figure 10:
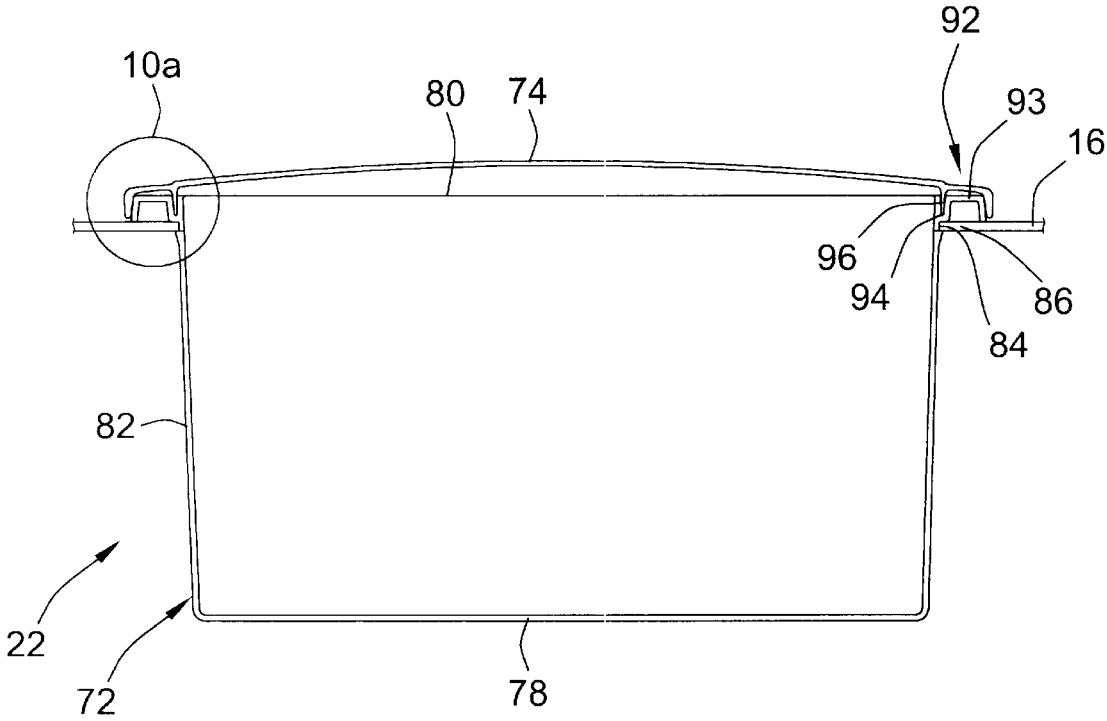
FIG. 10 is a cross section of FIG. 8 taken about line 10—10, but with the receptacle being mounted to the container, and with the receptacle lid closing the wipe receptacle.
Figure 10A:
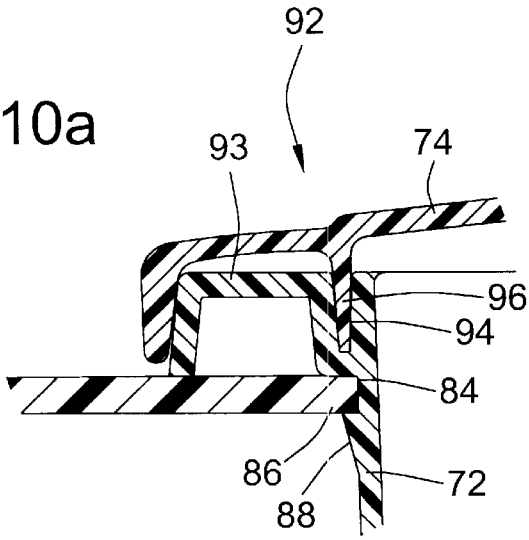
FIG. 10*a* is an enlarged view of the interface between the wipe receptacle and receptacle lid taken about detail 10*a* of FIG. 10.

The seal 92 is illustrated as a tongue and groove type, comprising a groove 94 formed horizontally into an outward projecting lip 93 along the edge of the open end 80 and a tongue 96 projecting horizontally from the lid 74 and into the groove 94 forming a seal via interference fit. As shown in FIG. 8, the groove extends along only three sides. Along the side where the hinges 90 are provided, clearance for pivoting movement is desired. As such the seal 92 is maintained through vertical interference between the tongue 96 and only one of the groove walls that continues along this side.

A snap connection 97 between the receptacle lid 74 and the wipe receptacle 72 is also be provided to keep the receptacle lid 74 covering the open end 80 and preferably to provide a horizontal biasing force on the outer lid 18 to better ensure proper sealing engagement for the tongue and groove seal 92. The snap connection 97 includes a snapping structure 98 extending from a lift tab 99 on the receptacle lid 74 and a corresponding snapping structure 100 projecting from the wipe receptacle 72. The snapping structures 98, 100 snap horizontally past one another as the lid is closed to provide a horizontal biasing force on the lid towards the wipe receptacle. The snapping structures 98, 100 are unsnapped by manually lifting the lift tab 99 horizontally outwardly.

All of the references cited herein, including patents, patent applications, and publications, are hereby incorporated in their entireties by reference.

The foregoing description of various embodiments of the invention has been presented for purposes of illustration and description. It is not intended to be exhaustive or to limit the invention to the precise embodiments disclosed. Numerous modifications or variations are possible in light of the above teachings. The embodiments discussed were chosen and described to provide the best illustration of the principles of the invention and its practical application to thereby enable one of ordinary skill in the art to utilize the invention in various embodiments and with various modifications as are suited to the particular use contemplated. All such modifications and variations are within the scope of the invention as determined by the appended claims when interpreted in accordance with the breadth to which they are fairly, legally, and equitably entitled.

What is claimed is:

1. An apparatus for dispensing new diapers and disposing of used diapers, comprising:

a container having a base, an outer wall, an enclosed area, and a partition wall, the base adapted to rest on a surface, the outer wall extending vertically upward from the base and surrounding the enclosed area, the partition wall dividing the enclosed area into a diaper compartment for storing new diapers, and a waste compartment for storing used diapers;

a slot through the outer wall extending to the diaper compartment, the slot being dimensioned closely to one of the new diapers such that new diapers are retained in the diaper compartment and such that new diapers may be removed through the slot;

an outer lid engaging the outer wall enclosing both of the diaper compartment and the waste compartment, the outer lid adapted to be opened; and a seal between the outer lid and the outer wall of the container for preventing odor from used diapers from escaping the container.

2. The apparatus of claim 1 wherein the container includes a lip projecting horizontally outward from a top end of the outer wall, the top end being opposite the base, the seal comprising a groove formed vertically into the lip and a tongue projecting vertically from the outer lid.

3. An apparatus for dispensing new diapers and disposing of used diapers, comprising:

a container having a base, an outer wall, an enclosed area, and a partition wall, the base adapted to rest on a surface, the outer wall extending vertically upward from the base and surrounding the enclosed area, the paitifion wall dividing the enclosed area into a diaper compartment for storing new diapers, and a waste compartment for storing used diapers;

a slot through the outer wall extending to the diaper compartment, the slot being dimensioned closely to one of the new diapers such that new diapers are retained in the diaper compartment and such that new diapers may be removed through the slot;

an outer lid engaging the outer wall enclosing both of the diaper compartment and the waste compartment, the outer lid adapted to be opened; and an inner lid covering one of the diaper compartment and the waste compartment, the inner lid adapted to be opened.

4. The apparatus of claim 3 wherein the inner lid covers the diaper compartment, further comprising a seal between the inner lid and the diaper compartment for preventing odor from the waste compartment from permeating new diapers stored in the diaper compartment.

5. The apparatus of claim 4 wherein the lid comprises a plate portion and flange portion integrally connected to the plate portion, the plate portion extending horizontally over the diaper compartment and resting on a top surface of the partition wall, the flange portion depending vertically downward from the plate portion and engaging the partition wall inside the diaper compartment.

6. The apparatus of claim 5 wherein the flange portion extends around an outer periphery of the plate portion, the flange portion including a horizontally outwardly projecting sealing rib engaging a portion of the outer wall that is exposed to the diaper compartment for providing said seal.

7. An apparatus for dispensing new diapers and disposing of used diapers, comprising:

a container having a base, an outer wall, an enclosed area, and a partition wall, the base adapted to rest on a surface, the outer wall extending vertically upward from the base and surrounding the enclosed area, the partition wall dividing the enclosed area into a diaper compartment for storing new diapers, and a waste compartment for storing used diapers;

a slot through the outer wall extending to the diaper compartment, the slot being dimensioned closely to one of the new diapers such that new diapers are retained in the diaper compartment and such that new diapers may be removed through the slot;

an outer lid engaging the outer wall enclosing both of the diaper compartment and the waste compartment, the outer lid adapted to be opened; and a wipe receptacle mounted to said container adjacent the slot, the wipe receptacle adapted to contain a plurality of wet baby wipes, and a receptacle lid adapted to cover the receptacle.

8. An apparatus for dispensing new diapers and disposing of used diapers, comprising:

a container having a base, an outer wall, an enclosed area, and a partition wall, the base adapted to rest on a surface, the outer wall extending vertically upward from the base and surrounding the enclosed area, the partition wall dividing the enclosed area into a diaper compartment for storing new diapers, and a waste compartment for storing used diapers;

a slot through the outer wall extending to the diaper compartment, the slot being dimensioned closely to one of the new diapers such that new diapers are retained in the diaper compartment and such that new diapers may be removed through the slot;

an outer lid engaging the outer wall enclosing both of the diaper compartment and the waste compartment, the outer lid adapted to be opened; and an opening through the outer wall extending into the waste compartment, the wipe receptacle being mounted into the opening, wherein the wipe receptacle includes a closed end, an open end and a plurality or receptacle walls extending horizontally between the closed end and the open end, the receptacle lid enclosing the open end.

9. The apparatus of claim 8 further comprising a seal between the wipe receptacle and the receptacle lid for preventing evaporation of liquid contained in wet baby wipes.

10. The apparatus of claim 9 wherein the receptacle lid is pivotably hinged to the wipe receptacle along a bottom edge of the wipe receptacle, wherein the receptacle lid pivots downward to expose the open end.

11. The apparatus of claim 8, wherein the wipe receptacle snaps substantially permanently into the container.

12. An apparatus for dispensing new diapers and disposing of used diapers, comprising:

a container having a base, an outer wall, an enclosed area, and a partition wall, the base adapted to rest on a surface, the outer wall extending vertically upward from the base and surrounding the enclosed area, the partition wall dividing the enclosed area into a diaper compartment for storing new diapers, and a waste compartment for storing used diapers;

a slot through the outer wall extending to the diaper compartment, the slot being dimensioned closely to one of the new diapers such that new diapers are retained in the diaper compartment and such that new diapers may be removed through the slot;

an outer lid engaging the outer wall enclosing both of the diaper compartment and the waste compartment, the outer lid adapted to be opened; and further comprising means for adjusting the size of the diaper compartment to fit one of a plurality of sizes of diapers.

13. An apparatus for dispensing new diapers and disposing of used diapers, comprising:

a container having a base, an outer wall, an enclosed area, and a partition wall, the base adapted to rest on a surface, the outer wall extending vertically upward from the base and surrounding the enclosed area, the partition wall dividing the enclosed area into a diaper compartment for storing new diapers, and a waste compartment for storing used diapers;

a slot through the outer wall extending to the diaper compartment, the slot being dimensioned closely to one of the new diapers such that new diapers are retained in the diaper compartment and such that new diapers may be removed through the slot;

an outer lid engaging the outer wall enclosing both of the diaper compartment and the waste compartment, the outer lid adapted to be opened; and wherein the diaper compartment includes a sloped bottom surface sloping downward toward the slot.

14. An apparatus for dispensing new diapers and disposing of used diapers, comprising:

a container having a base, a plurality of sides forming a generally rectangular outer wall, an enclosed area, and a partition wall, the base adapted to rest on a surface, the sides extending vertically upward from the base and surrounding the enclosed area, the partition wall dividing the enclosed area into a diaper compartment for storing new diapers, and a waste compartment for storing used diapers;

a slot through one of the sides extending to the diaper compartment, the slot being dimensioned closely to one of the new diapers such that new diapers are retained in the diaper compartment and such that new diapers may be removed through the slot;

an outer lid engaging the outer wall enclosing both of the diaper compartment and the waste compartment, the outer lid adapted to be opened;

an inner lid covering one of the diaper compartment and the waste compartment, the inner lid adapted to be opened; and a wipe receptacle mounted to said container adjacent the slot, the wipe receptacle adapted to contain a plurality of wet baby wipes, and a receptacle lid adapted to cover the receptacle.

15. The apparatus of claim 14 further comprising a seal between the outer lid and the outer wall of the container for preventing odor from used diapers from escaping the container.

16. The apparatus of claim 15 wherein the inner lid covers the diaper compartment, further comprising a seal between the inner lid and the diaper compartment for preventing odor from the waste compartment from permeating new diapers stored in the diaper compartment.

17. The apparatus of claim 16 wherein the lid comprises a plate portion and flange portion integrally connected to the plate portion, the plate portion extending horizontally over the diaper compartment and resting on a top surface of the partition wall, the flange portion depending vertically downward from the plate portion and engaging the partition wall inside the diaper compartment.

18. The apparatus of claim 14 further comprising an opening through one of the sides extending into the waste compartment, the wipe receptacle being mounted into the opening, wherein the wipe receptacle includes a closed end, an open end and a plurality or receptacle walls extending horizontally between the closed end and the open end, the receptacle lid enclosing the open end.

19. The apparatus of claim 14 further comprising a seal between the wipe receptacle and the receptacle lid for preventing evaporation of liquid contained in wet baby wipes.

20. The apparatus of claim 14 wherein the receptacle lid is pivotably hinged to the wipe receptacle along a bottom edge of the wipe receptacle, wherein the receptacle lid pivots downward to expose the open end.

21. The apparatus of claim 18, wherein the wipe receptacle snaps substantially permanently into the container.

22. The apparatus of claim 14 further comprising means for adjusting the size of the diaper compartment to fit one of a plurality of sizes of diapers.

23. The apparatus of claim 14 wherein the diaper compartment includes a sloped bottom surface sloping downward toward the slot.

* * * * *